US006383086B1

(12) United States Patent
Flood

(10) Patent No.: US 6,383,086 B1
(45) Date of Patent: May 7, 2002

(54) PRACTICE PUTTER WITH OFF-SET SHAFT

(75) Inventor: James J. Flood, Solano Beach, CA (US)

(73) Assignee: Carbite Golf Company, San Diego, CA (US)

( * ) Notice: Subject to any disclaimer, the term of this patent is extended or adjusted under 35 U.S.C. 154(b) by 0 days.

(21) Appl. No.: 09/477,913

(22) Filed: Dec. 31, 1999

(51) Int. Cl.[7] ..... A63B 69/36; A63B 53/04
(52) U.S. Cl. ..... 473/219; 473/256; 473/330
(58) Field of Search ..... 473/330, 313, 473/314, 219, 223, 256, 246, 248, 340, 242, 249, 235

(56) References Cited

U.S. PATENT DOCUMENTS 1,064,916 A * 6/1913 Kelly
2,388,463 A * 11/1945 Benecke
2,396,408 A * 3/1946 Benecke
2,820,638 A * 1/1958 Morrison
3,191,936 A * 6/1965 Guier
3,219,348 A * 11/1965 Dishner
3,700,244 A * 10/1972 Liotta
3,743,297 A * 7/1973 Dennis
3,759,527 A * 9/1973 Witherspoon
4,725,062 A * 2/1988 Kinney
5,026,064 A * 6/1991 Novosel
5,306,010 A * 4/1994 Choi
5,335,909 A * 8/1994 Green
5,599,021 A * 2/1997 Lary
5,692,969 A * 12/1997 Schooler

* cited by examiner

*Primary Examiner*—Sebastiano Passaniti
(74) *Attorney, Agent, or Firm*—Craig E. Shinners

(57) ABSTRACT

A practice golf club putter is provided where the putter head is ball-shaped having a bore in which a shaft is inserted and firmly affixed to form a single unit. The shaft has a single bend closely proximate to the putter head that provides an offset between the longitudinal axis of the shaft and the axis of the bore. This offset provides numerous advantages for both right and left handed golfers. Specifically, a golfer may position the shaft of the practice putter in an off-set relationship with respect to the hitting zone of the putter head so that the club alignment approximates the relationship of the shaft angle with respect to the hitting zone of a USGA-approved putter.

12 Claims, 2 Drawing Sheets

PRACTICE PUTTER WITH OFF-SET SHAFT

BACKGROUND OF THE INVENTION

1. Field of the Invention

This invention relates to a golf club and, more specifically, to a practice putter.

2. Description of Related Art

When playing golf, a significant number of strokes on each hole are taken attempting to putt the golf ball into the hole. Indeed, during an 18-hole round of golf, it is not uncommon for a golfer to putt 30 to 40 times. The importance of the putting stroke is made obvious when it is considered that a typical golfer will only take between 80–90 strokes to finish the round. Thus, 30% to 50% of the strokes in a round of golf could be taken with the putter. Clearly, if a golfer wishes to improve their score, mastery of the putting stroke is an absolute necessity.

The use of a practice putter, such as shown in FIG. 1, has been used for many years by golfers. The putter 10 of FIG. 1 has a shaft 12 terminating at one end in a putter grip 14 and at the other end into a club head 16. Head 16 comprises a generally spherical shape so that a curved convex striking surface is used to strike a golf ball 17. If curved portion of the striking surface (the "hitting zone") strikes the golf ball in an off-line manner, the convex surface will cause an accentuated deflection of the golf ball to the right or left of the intended path, thereby indicating a swing that is off-plane. The golfer is thus provided with immediate feedback so that they may adjust the mechanics of their stroke swing. It is widely believed that the use of practice putter 10 will help the golfer to "groove" the putting swing with a conventional putter so that it is consistently on-plane when putting during a round of golf. As used herein, the phrase "conventional putter" means that a golf club approved by the United States Golf Association (USGA) for use in putting a golf ball.

Unfortunately, the prior art practice putter 10 does not replicate the weight distribution and alignment of conventional putters used by most golfers. More specifically, since head 16 is attached directly to the shaft, the hitting portion of head 16 is directly in line with shaft 12. Thus, the golfer must assume a grip on the shaft that may differ from the grip when using their actual putter. Further, the visual perspective is different since the shaft is directly in line with the hitting zone of the practice putter while the conventional putters typically have an off-set hitting zone. Further, with the wide number of available USGA-approved putters, it will be readily apparent that the shaft will attach to the putter head at a variety of positions so the relationship of the hitting zone with respect to the shaft will vary widely.

For example, FIG. 3A shows a putter where the shaft attaches to the heel of head 20. In this configuration, the shaft 22 is off-set from the hitting zone 24 by a distance of about an inch as represented at 26. Further, there is an angle, $\lambda$, that is formed between the longitudinal axis 28 of shaft 22 and a vertical axis 30 through hitting zone 24. Thus, the golfer who practices with practice putter 10 will not only have a different visual perspective but will also have to hold the practice putter with shaft angle that differs from the shaft angle of the putter that will be used on the golf course. In contrast to the offset alignment of the putter in FIG. 3A, the putter shown in FIG. 3B will have a completely different alignment of the shaft with respect to the hitting zone. Specifically, in FIG. 3B the shaft 32 of the putter attaches to the center of the head but is offset to the rear of the hitting zone 24. Clearly, this type of putter presents the golfer a completely different visual perspective and alignment from that provided by putter 10. What is needed is a practice putter that can be aligned in a manner comparable to the alignment the golfer will use with his or her normal putter. What is also needed is a practice putter that provides the golfer with a visual perspective that more closely approximates the visual perspective the golfer has when putting with his or her conventional putter.

SUMMARY OF THE INVENTION

The present invention provides a practice golf club putter that has a spherical putter head attached to an off-set shaft. More specifically, the shaft is attached in an off-set from the club head so that the hitting zone is more closely oriented in a manner resembling the orientation between the shaft and club head of an USGA-approved putter.

In one preferred embodiment of the practice golf club putter of the present invention, the putter head is a cast, stainless steel ball having a bore in which a shaft is inserted and firmly affixed to form a single unit. A ferrule is attached at the junction of the shaft and head for strengthening purposes. The shaft has a single bend closely proximate to the ferrule. In contrast to the prior art practice putter of FIG. 1, the present embodiment provides an offset between the longitudinal axis of the shaft and the axis of the bore. This offset provides numerous advantages which will be described in the following section. Advantageously, both right and left handed putters may use the practice club of the present invention. Further, the golfer may position the shaft of the practice putter with respect to the hitting zone of the club head in an manner that more closely approximates the relationship of the shaft angle with respect to the hitting zone of a USGA-approved putter.

BRIEF DESCRIPTION OF THE DRAWINGS

Referring now to the drawings in which like-reference numbers represent corresponding parts throughout:

FIG. 8 illustrates means for aligning the practice putter.

DETAILED DESCRIPTION OF THE PREFERRED EMBODIMENT

Figure 4:
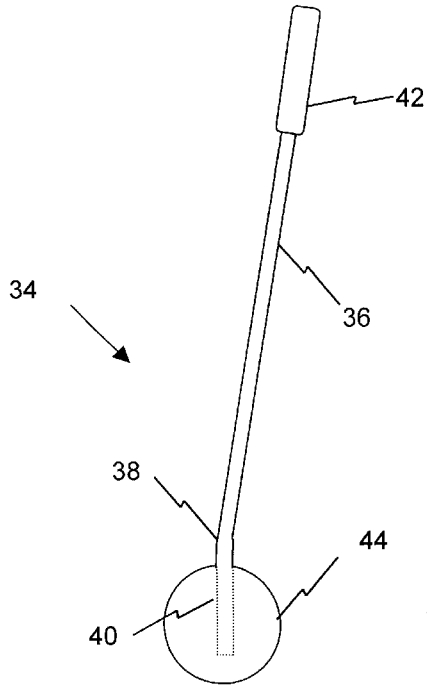
FIG. 4 illustrates an embodiment of the practice putter of the present invention.

Referring now to FIG. 4, an illustration of the practice putter of the present invention is shown. Practice putter 34 comprises a shaft 36 portion that is about 34 inches in overall length. Shaft 36 has a single bend 38 at one end forming a terminal portion 40 of the shaft. Terminal portion 40 has a length of between about 2 inches and 2½ inches although it could have a length of up to about 5 inches. Clearly, the length of the terminal portion 40 is dependent on where bend 38 is positioned along shaft 36. The length of the terminal portion preferably comply with United State Golf Association (USGA) regulations which specify that any bends in a putter shaft must be within five (5) inches of the ground. The terminal portion 40 of shaft 36 is not tapered and is preferably a "370 tip" which is a 0.370 inch outside diameter. In the preferred embodiment, approximately the bottom one-third of shaft 36 is constant in diameter (parallel walls) with a step that changes to a larger diameter shaft. In one preferred embodiment, shaft 36 steps from the 0.370 diameter to a 0.600 inch diameter. The butt of shaft 36 opposite the single bend 38 is covered with a putter grip 42.

Figure 5:
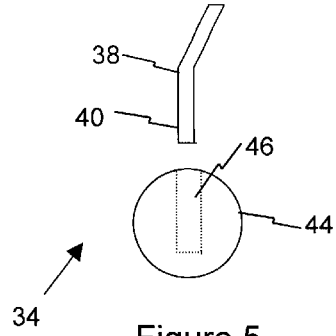
FIG. 5 is an exploded view of a portion of the practice putter shown in FIG. 4.

As shown in the exploded view of FIG. 5, putter 34 further includes a stainless steel putter head 44 having a substantially spherical shape. Putter head 44 may be formed by casting or other similar methods and has a weight of about 12 ounces, plus or minus 0.5 ounce. The weight of putter head 44 is important in that it is necessary to closely replicate the weight of a typical putter head of an USGA-approved putter. In one preferred embodiment, the putter head 44 has a diameter of about 1¾ inches and is finished with a coating such as, by way of example, a low shine gel-coat. Putter head 44 has a single bore 46 that extends from one surface through the center of putter head 44. In a preferred embodiment, the depth of bore 46 approaches the opposite surface of putter head 44 but does not extend completely through putter head. The diameter of bore 46 is also about $\frac{3}{8}^{th}$ inch.

Shaft 36 is positioned relative to putter head 44 so terminal portion 40 is press-fit into bore 46. The walls of bore 46 may be coated with an epoxy to provide better retention of shaft 36 within bore 46. A ferrule (not shown) provides an aesthetic appearance to the junction between shaft 36 and putter head 44 and provides some strengthening at the junction.

Figure 6:
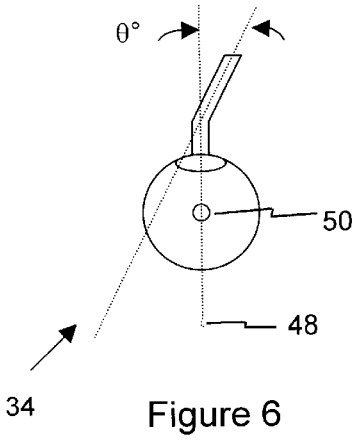
FIG. 6 shows one orientation of the practice putter of the present invention.

Refer now to FIG. 6. When assembled, shaft 36 forms an angle θ of between one to 15 degrees with respect to the longitudinal axis defined by bore 46. The longitudinal axis is illustrated by way of dashed line 48. In particularly preferred embodiments, bend 38 is between about three (3) to five (5) degrees. In other embodiments (not illustrated), the shaft angle θ can be as much as 90 degrees by forming a corresponding bend 38. To prevent torque from developing during the swing, it is desirable to minimize the length of terminal portion 40 extending beyond putter head 44. In one preferred embodiment, minimal torque is obtained with terminal portion being just marginally longer than the diameter of putter head 44. However, to more closely replicate the balance of a USGA-approved putter and the orientation of the shaft with respect to the striking area of the club face, it may be desirable in some applications to provide for an increase in the length of terminal portion 40. For example in some embodiments, terminal portion 40 may extend from three to about five inches beyond club head 44.

Figure 1:
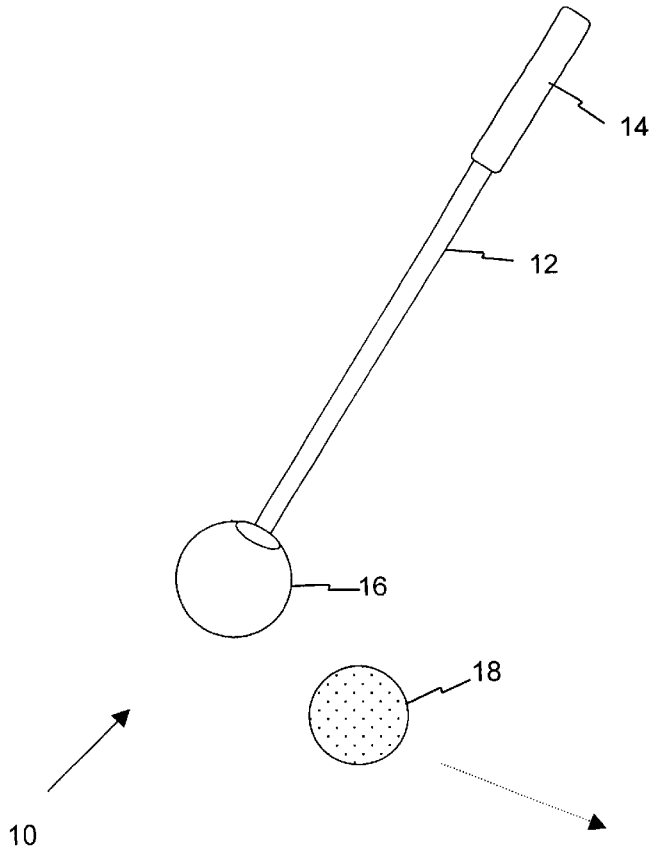
Figure 1 (Prior Art)
FIG. 1 is an illustration of a prior art practice putter.
Figure 7:
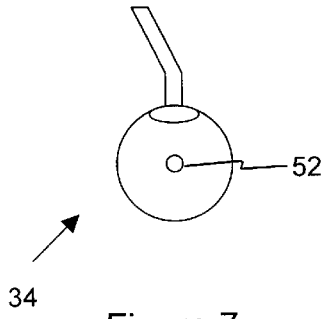
FIG. 7 shows another orientation of the practice putter of the present invention.
Figure 2:
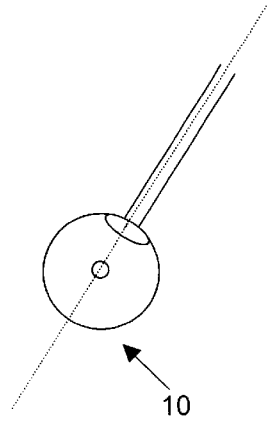
Figure 2 (Prior Art)
FIG. 2 is another illustration of the prior art practice putter of FIG. 1.
Figure 3A:
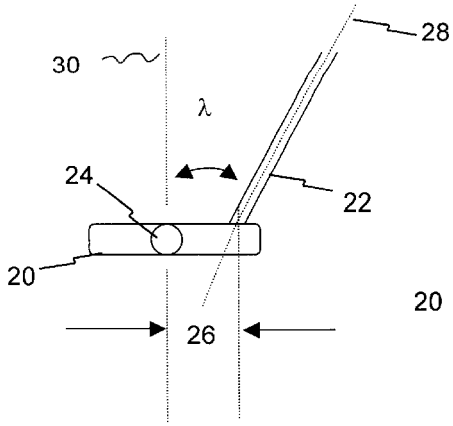
Figure 3A (Prior Art)
FIGS. 3A and 3B are illustrations of conventional club heads for USGA-approved putters.
Figure 3B:
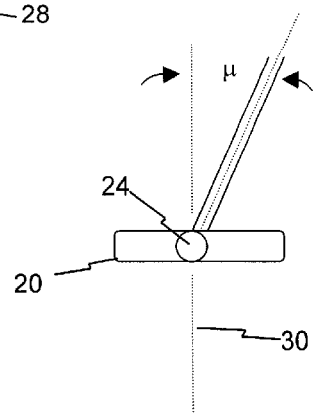
Figure 3B (Prior Art)

In FIG. 6, alignment of putter 34 during a stroke is shown for use by a right-handed golfer. With this alignment, the putter head 44 should strike the ball 17 (see FIG. 1) at the hitting zone denoted by circle 50. In this position, shaft 36 presents an orientation with respect to the hitting zone 50, that approaches the alignment of the offset putter shown in FIG. 3B. In FIG. 7, hitting zone 52 will be used to strike the golf ball during the swing by a left-handed golfer. It will be appreciated that hitting zone 52 is diametrically opposite hitting zone 50 and that this rotated alignment more closely resembles the alignment a left-handed golfer would experience if putting with the putter shown in FIG. 3B. Advantageously, by rotating the shaft of putter 34, as shown in FIG. 7, about 45° to the right and downward (clockwise), it is possible for a right-handed golfer to align the putter and to position the hitting zone at an offset relative to the shaft. This rotated alignment more closely resembles the alignment a golfer would experience if putting with the putter shown in FIG. 3A. The practice putter of the present invention may also be advantageously aligned to provide an under-slung alignment by spinning the shaft of putter 34, as shown in FIG. 7, about 90° in a clockwise direction so that the terminal portion remains pointing upward. In this manner, it is possible for a right-handed golfer to align the putter and to position the hitting zone at an under-slung alignment relative to the shaft. This particular alignment more closely resembles the "M1" putter, commercially available from Carizma Golf Company, the assignee of the present invention.

Referring now to FIG. 8, a top view of the putter head 44 is shown with a plurality of sight dots 54. In this view, bore 46 is shown without a shaft portion so as to simplify the illustration. Since putter head 44 is substantially spherical, sights dots 54 may be positioned midway along the circumference of the putter head between the bore 56 and the respective hitting zone, that is hitting zones 50 and 52 for both right-handed and left-handed use. In the preferred embodiment, four sight dots 54 are provided, spaced equal distance around the circumference of the putter head. Sight dots 54 are preferably applied to the putter head prior to the application of the gel coat. These sight dots may be painted onto the putter head 44 or the application of a decal as part of the finishing process. Alternatively, sight dots may be formed as a slight depression when the putter head is manufactured. With four sight dots, a golfer is able to readily align the selected hitting zone along the intended target line regardless of the type of regulation putter the golfer is currently using.

After reading the above description, it should be apparent that the present invention enables a golfer to practice the putting stroke using a proven training device that is adaptable to the specific design of the golfer's preferred USGA-approved putter. Accordingly, the golfer can not only groove their putting stroke but can do so with the same grip and visual references that the golfer will find when using their USGA-approved putter during a round of golf.

While certain exemplary preferred embodiments have been described and illustrated in the accompanying drawings, it is to be understood that such embodiments are merely illustrative of and not restrictive on the broad invention. Further, it is to be understood that this invention shall not be limited to the specific construction and arrangements shown and described since various modifications or changes may occur to those of ordinary skill in the art without departing from the spirit and scope of the invention as claimed.

I claim:

1. A practice golf putter for providing feedback as to whether a putting swing is proper, said putter comprising:

a putter head having a spherical shape, said putter head having a bore substantially extending from one surface through the center of said putter head and terminating closely proximate the opposite end of said putter head;

a shaft having a single bend, said bend being proximate to one end of said shaft forming thereby a terminal portion, said terminal portion having a diameter substantially corresponding to the diameter of said bore and a length substantially corresponding to the diameter of said putter head; said shaft affixed to said putter head such that a substantial portion of said terminal portion is retained in said bore and said shaft extends away from said putter head at an angle relative to the longitudinal axis of said bore.

2. The practice putter of claim 1 wherein said shaft extends at an angle of between about one degree (1°) to five degrees (5°) relative to the longitudinal axis of said bore.

3. The practice putter of claim 1 wherein said shaft extends at an angle of about five degrees (5°) relative to the longitudinal axis of said bore.

4. The practice putter of claim 1 wherein said shaft extends at an angle of about three degrees (3°) relative to the longitudinal axis of said bore.

5. The practice putter of claim 1 wherein said spherical putter head comprises a plurality of hitting zones where, for each hitting zone, said shaft is positioned offset from the axis defined by said bore.

6. A practice putter comprising:

a shaft having a grip on one end and a bend proximate to the opposite end of said shaft forming thereby a terminal portion;

a spherical club head having a convex surface for striking a golf ball, said club head having a bore extending from the surface of said club head through the center of said club head and terminating closely proximate the opposite end of putter head; and means for attaching said club head to substantially the entire length of said terminal portion, said shaft extending from said club head at an angle offset from the axis defined by said bore.

7. The practice putter of claim 6 wherein said shaft extends at an angle of between about one degree (1°) to five degrees (5°) relative to the longitudinal axis of said bore.

8. The practice putter of claim 6 wherein said shaft extends at an angle of about one degree (1°) relative to the longitudinal axis of said bore.

9. The practice putter of claim 6 wherein said shaft extends at an angle of about three degrees (3°) relative to the longitudinal axis of said bore.

10. The practice putter of claim 6 wherein said means for attaching comprises a coating of adhesive applied to a portion of said terminal portion to afix the terminal portion of said shaft in said bore.

11. The practice putter of claim 6 further comprising means for aligning said practice putter.

12. The practice putter of claim 6 wherein said spherical putter head comprises a plurality of hitting zones where, for each hitting zone, said shaft is positioned offset from the axis defined by said bore.

* * * * *